US006848983B2

(12) United States Patent
Gallegos et al.

(10) Patent No.: US 6,848,983 B2
(45) Date of Patent: Feb. 1, 2005

(54) DRYWALL KNIFE OR BLADE REFINISHER TOOL

(76) Inventors: Roy C. Gallegos, 212 E. 38th St., Boise, ID (US) 83714; Gerald B. Gallegos, 212 E. 38th St. #1, Boise, ID (US) 83714

( * ) Notice: Subject to any disclaimer, the term of this patent is extended or adjusted under 35 U.S.C. 154(b) by 12 days.

(21) Appl. No.: 10/322,267

(22) Filed: Dec. 17, 2002

(65) Prior Publication Data

US 2003/0134583 A1 Jul. 17, 2003

Related U.S. Application Data

(60) Provisional application No. 60/339,770, filed on Dec. 17, 2001.

(51) Int. Cl.[7] ..... B24B 25/00

(52) U.S. Cl. ..... 451/319; 451/321; 451/552; 451/555

(58) Field of Search ..... 451/312, 319, 451/32, 321, 540, 552, 556, 555, 557, 558

(56) References Cited

U.S. PATENT DOCUMENTS 1,594,246 A * 7/1926 Dechert ..... 76/82
2,160,979 A * 6/1939 Moeller ..... 451/555
3,841,030 A * 10/1974 Laszlo ..... 451/358
3,921,341 A * 11/1975 Thompson ..... 451/558
4,078,455 A * 3/1978 Brody ..... 76/88
4,498,360 A * 2/1985 Milum ..... 76/88
4,759,153 A * 7/1988 Cohen ..... 451/45
4,961,287 A 10/1990 Compton
4,991,357 A * 2/1991 Stickles, Sr. ..... 451/555
5,197,232 A * 3/1993 Ellestad ..... 451/558
5,458,534 A * 10/1995 Campione et al. ..... 451/555
5,461,943 A * 10/1995 Munkel ..... 76/89.2
6,030,283 A * 2/2000 Anderson ..... 451/558

* cited by examiner

*Primary Examiner*—Timothy V. Eley
(74) *Attorney, Agent, or Firm*—Robert L. Shaver; Dykas, Shaver & Nipper

(57) ABSTRACT

Presented is a blade sharpener, resurfacer, and planer, for sharpening flat or beveled blades of a linear edged tool, such as a drywall finishing tool and other tools edges, such as concrete trowel blades. The device of the invention makes using a file for such tasks much more precise, and much safer.

10 Claims, 4 Drawing Sheets

DRYWALL KNIFE OR BLADE REFINISHER TOOL

PRIORITY

This document claims priority from the provisional application filed on Dec. 17, 2001 with a Ser. No. 60/339,770 of the same title.

BACKGROUND OF THE INVENTION

1. Field of the Invention

The present invention generally relates to sharpening tools, and more particularly relates to a sharpening tool that will resurface, plane, and sharpen tools such as drywall tools, drywall knives, trowels, and other tools. This repairs and prolongs tool life.

2. Background Information

It is often desirable to thoroughly or selectively smooth the surface of rigid walls or other working surfaces. A surface smoothing treatment can be performed to alter the shape of the wall, remove unwanted material from the wall, and/or improve the adherence and appearance of preliminary and final coatings on the wall. For example, in preparing the joints of drywall in preparation for texturing or painting, a worker may wish to smooth drywall joints, and to imperfections and screw depressions by applying a coat of drywall compound using a drywall knife or blade.

One step in preparing a drywall surface is to uniformly smooth or scrape all portions of the surface without removing too much material from any one portion. This is done by smoothing over the wall and drywall joints with a flat or planar surfaced tool in a single smooth motion with the tool. Further, it is desirable to maintain a sharp scraping edge on such a tool, which can he quickly and easily resurfaced to remove nicks. Many times the screws used in securing drywall to the studs of a building are not sufficiently countersunk, and contact with the drywall surfacing tool causing nicks or scratches in the blade of the drywall tool. Drywall flashing material will also scratch or mar the working surface of a drywall knife or blade. These nicks, scratches, and gouges will leave lines or grooves in the surface being worked, which renders the tool useless for further work. At present, there is no practical method of resurfacing the working edge of such a tool, and thus a new tool may have to be purchased. Additionally, certain have a linear working surface like a drywall tool, but tools do not require a flat edge for scraping. Such tools require a beveled edge for their particular use. As with the edge of a drywall tool, there is not a practical way to sharpen such a linear edged on the jobsite.

Thus, there exists a need for a portable device for resurfacing the working edge of a linear edged tool, such as a drywall knife, concrete working trowels, or other tools that have a linear edge. Some of these edges would have a flat edge with two 90 degree corners, and others might require a single edge formed by a bevel. Such a resurfacing device needs to be safe and easy to use, and portable so that it can easily be brought to a jobsite and made available for workers to use on the site. Such a device would need to be designed to allow a linear edge to be sharpened so that it is perfectly straight, which is impossible to do when using a tool such as a file alone worked against the edge of a blade by hand. In such a case, the edge of the blade would be left with high and low spots, and would no longer serve its function. Those having ordinary skill in the art will appreciate that these and other needs are not provided by devices available to craftsmen, and are met by the present invention. Drywall knives and concrete trowels tend to become worn and rounded with use. This device makes such blade edges flat, straight, and true again, prolonging tool life.

It is therefore an object of the present invention to provide an inexpensive planing or sharpening tool that provides a range of light to heavy duty shaving action from the edge of a linear blade. It is also an object of the invention to provide such a device that can utilize commonly available files that may be changed as required.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The above objects and others not specifically recited are realized in the blade sharpener of the invention. The blade sharpener of the invention includes a sharpener body in which is defined a file cavity and a blade slot. The file cavity is sized to hold a file, which can be a standard hand file or one specifically made for the device. The blade slot is a slot in which the blade to be sharpened is inserted, and through which the blade may contact the file held securing in the file cavity. A file securing means is used to hold the file in the file cavity. This can be set screws, a friction grip, or other securing means that releasably secure the file. The blade sharpener may be moved back and force against a stationary blade to be sharpened, or the blade sharpener may remain stationary and the blade to be sharpened can be moved back and forth, so that the file removes nicks, makes the blade linear, and to the desired angle. For instance, one embodiment of the device utilizes a blade cavity that presents the blade to be sharpened at a 90 degree angle to the file. When finished, such a device results in a blade that has two 90 degree angles and flat edge. Other embodiments of the device can have the blade slot at a different angle from the blade, such as 30 degrees or 45 degrees. When used with a blade, these result in a blade with a linear sharp edge, with a bevel of 30 degrees or 45 degrees. Other angles would also be possible.

One embodiment of the present invention utilizes a sharpener body made from one piece. This might be made from plastic, wood, or a suitable metal such as aluminum, steel or brass. Another embodiment of the invention has a sharpener body that is made in three pieces. In this embodiment, a first and second shoulder piece attach to the base section and thereby define one or more blade slots and the file cavity for holding the file. The first and second shoulder sections would typically be attached by shoulder screws, but other means of attachment would also be suitable. One version of the device has multiple blade slots each at different angles, so that tools can be sharpened at different angles. One embodiment of the device has a blade slot that is much wider than the width of the blade. This allows this embodiment of the blade sharpener to be utilized to create a flat edge in which the edges of the working surface of the blade are at 90 degree angles, and the edge of the blade is flat. A beveled blade can also be sharpened in this device by placing the blade to be sharpened at an angle, so that it is touching the top edge of one side of the blade slot and the bottom edge of the other side of the blade, resulting in a beveled, linear edge.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
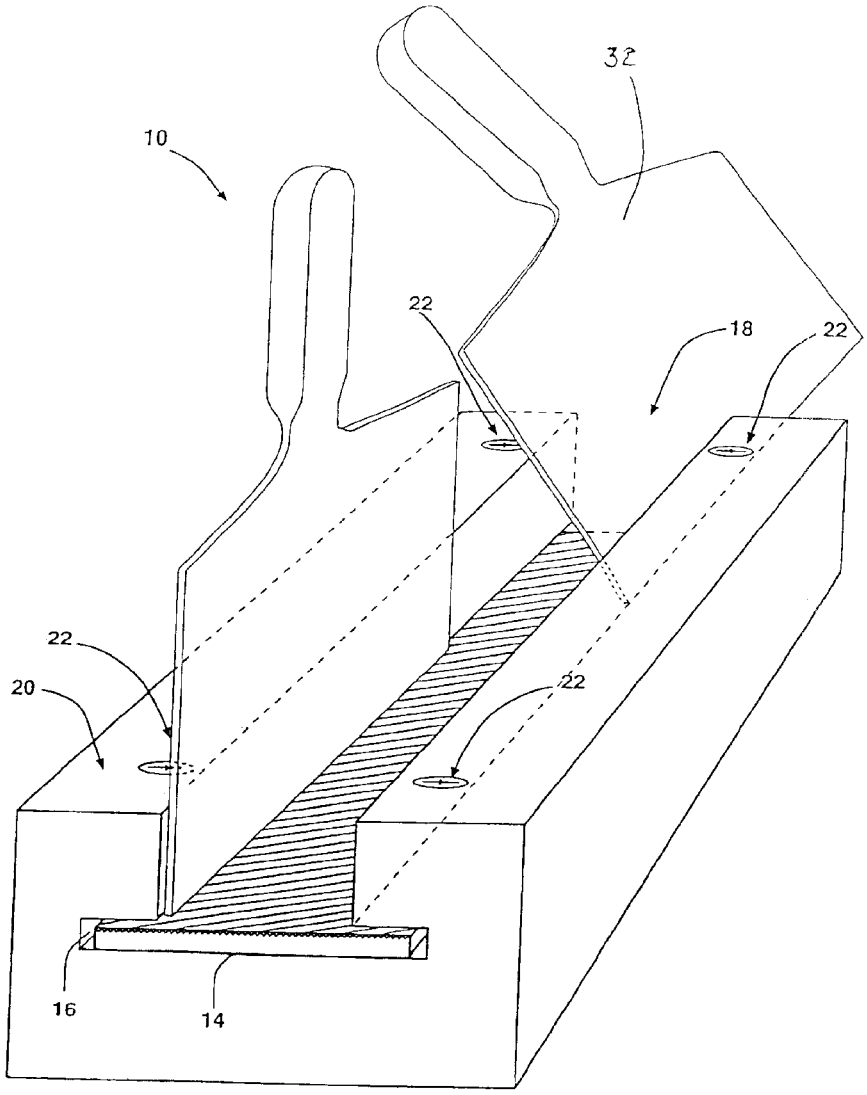
FIG. 1 is a perspective view of the device of the invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

FIGS. 1–5 show some of the preferred embodiments of the blade sharpener of the invention. FIG. 1 shows an embodiment of the invention in which the sharpener body 12 is made from one piece. This could be made from any type of plastic, of a suitable metal, or wood. The sharpener body 12 defines a file cavity 16 in which a file 14 is placed and secured in the sharpener body 12 with a file securing means 20, which in this case are several set screws 22. The sharpener body 12 also defines a blade slot 18 through which a blade 32 can be inserted for sharpening by contact with the file 14. Although this sharpener would work with a number of different types of blades, it is particularly useful for the blade of a drywall finishing tool. The blade slot 18 of this particular embodiment of the device is wide enough so that the blade 32 can be placed in contact with the file 14 parallel with a side wall of the blade slot, as shown in FIG. 1, for a flat edge. The blade 32 can also be placed at an angle with its leading edge touching the file, and the upper part of the blade resting against the corner of the opposite side wall of the blade slot. When the blade is held in a vertical position, the blade is sharpened to have perfect two 90 degree edges and to have a flat end surface. When the blade is held at an angle, which is also shown in FIG. 1, the blade is sharpened to have a sharp edge and a bevel. It is advantageous for the embodiment with a wider blade slot to include a gap between the working surface of the file and the upper surface of the file slot. This gap prevents the blade from binding as it is being sharpened, and is visible in FIG. 1.

The blade sharpener 10 can be configured so that the file 14 is a standard hand file that is inserted into the sharpener body 12. A specially constructed file can also be used with the device.

Figure 2:
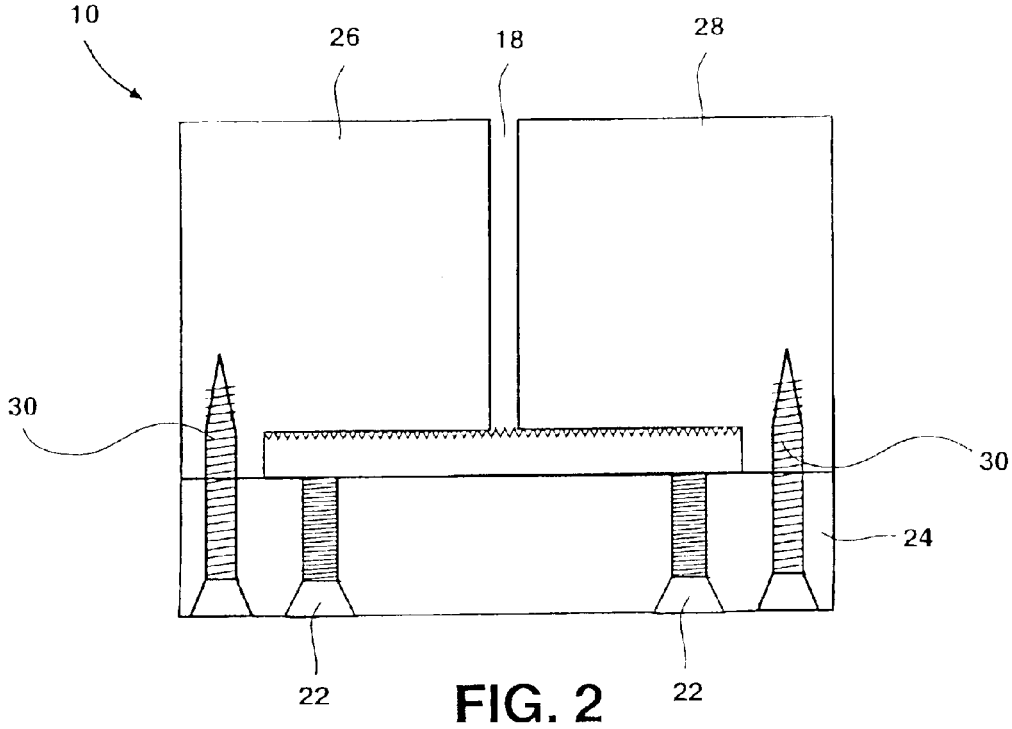
FIG. 2 is an end, cutaway view of an embodiment of the present invention in which the sharpener body is made of more than one piece.

FIG. 2 shows another embodiment of the blade sharpener of the blade sharpener 10. This embodiment of the blade sharpener is made in more than one piece, in this case three pieces. This device includes a base section 24, a first shoulder section 26, and a second shoulder section 28. These are joined together by shoulder screws 30. Set screws 22 hold the file in place in the file cavity 16. In this particular embodiment, the blade slot 18 is narrower than that shown in FIG. 1, and holds a blade in a vertical position against the file, which results in a flat surface with two 90 degree edges on the tip of the blade.

Figure 3:
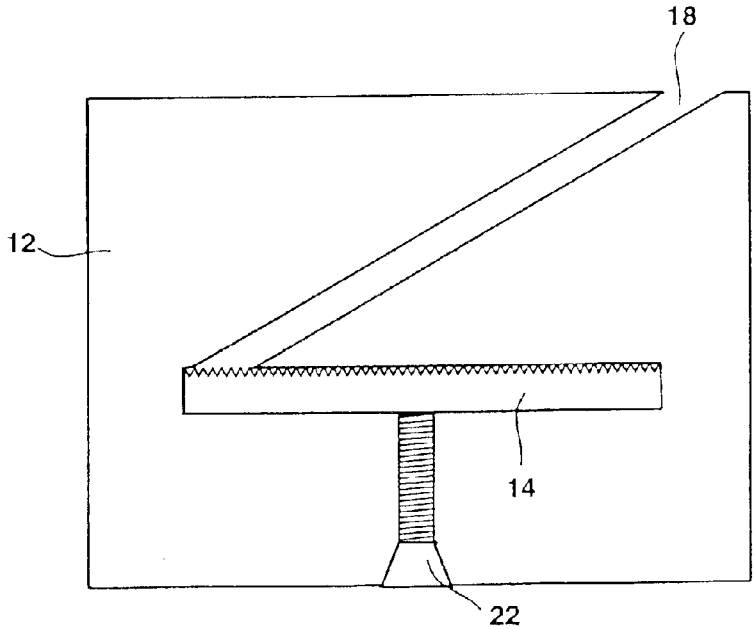
FIG. 3 is an end, cutaway view of another embodiment of the device.

FIG. 3 shows another preferred embodiment of the present invention, one in which the access cavity 18 is at an angle, which will result in a blade being sharpened with an edge and a bevel. This embodiment could be made with the sharpener block 12 being made from one piece, as shown, or it could also be constructed in more than one piece as shown in FIG. 2.

Figure 4:
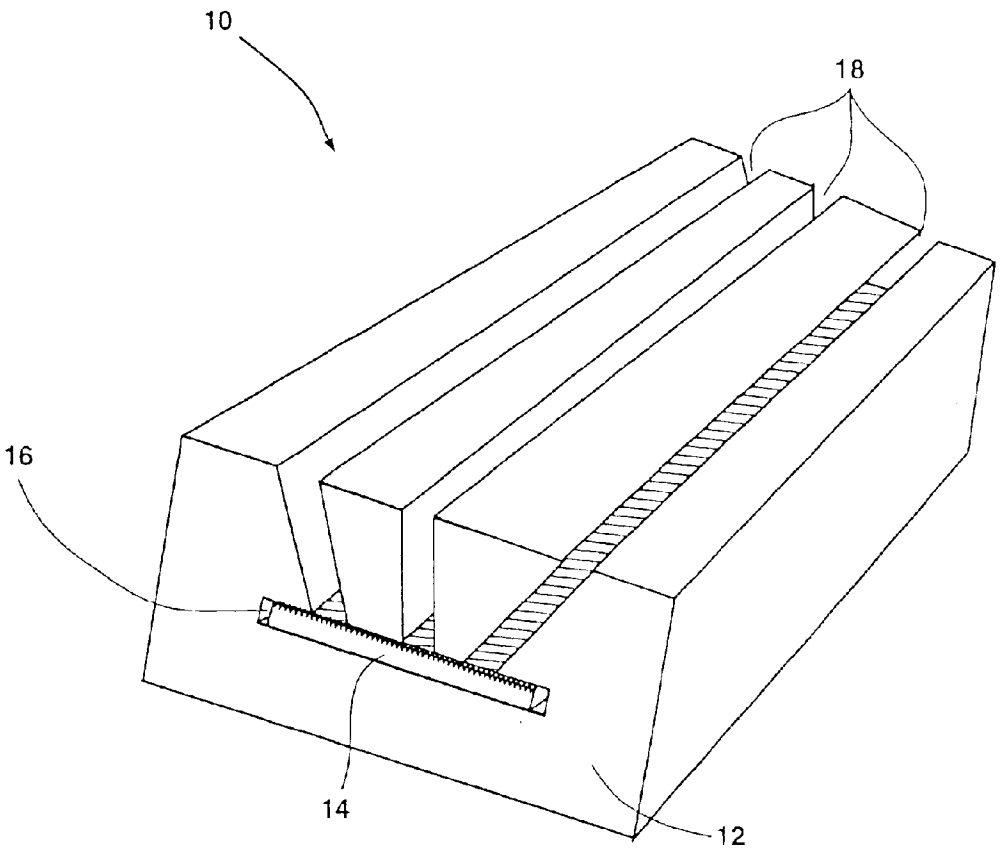
FIG. 4 is a perspective view of an embodiment of the device that presents multiple angled slots for sharpening blades at different angles.

FIG. 4 shows another embodiment of the blade sharpener 10. In this embodiment, there are multiple access cavities 18, each with a different angle. In the example shown in FIG. 4, the middle blade slot would be for sharpening a blade at a 90 degree angle, to have a flat edge. The other two would be at other angles such as 30 degrees and 45 degrees. As with the other designs, the sharpener body 12 could be made from one piece or from several pieces. A file securing means would also be incorporated into the design.

Figure 5:
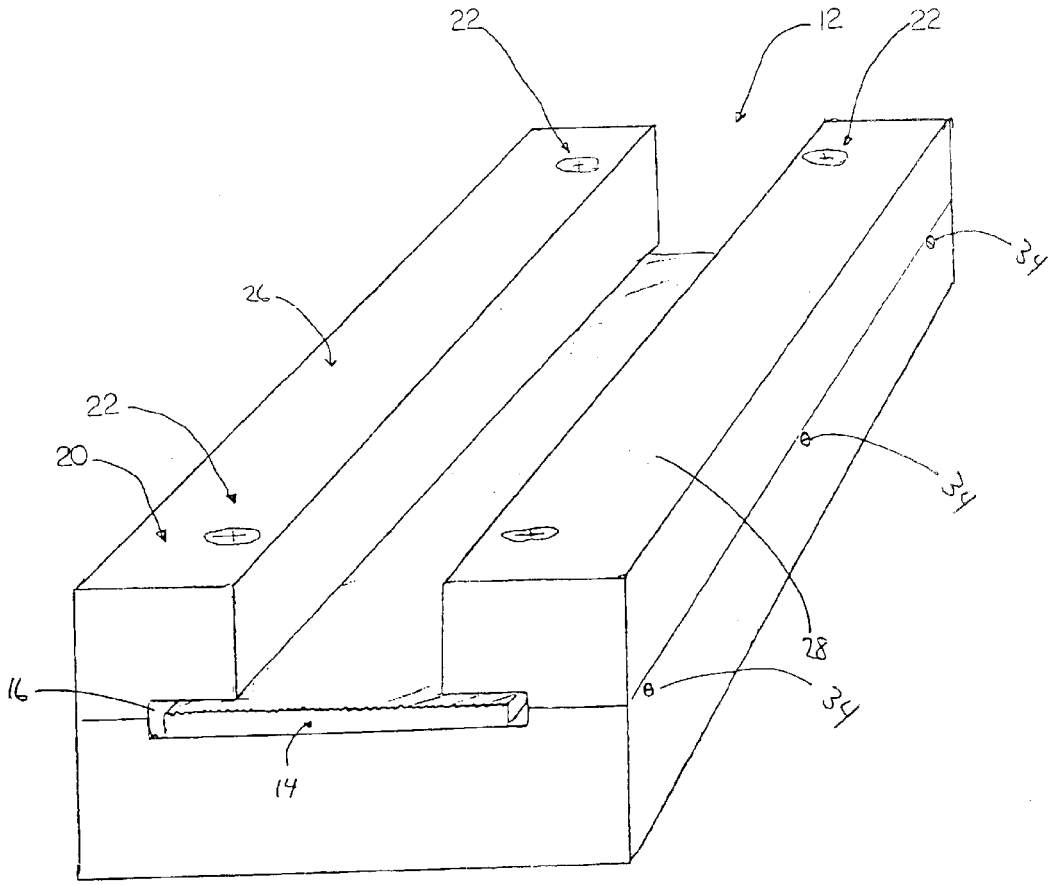
FIG. 5 is a perspective view of an embodiment of the device in which the upper portions can be removed, leaving a file surface for other uses.

FIG. 5 shows an embodiment of the design in which the first shoulder section 26 and the second shoulder section 28 can be removed. The file can then be secured in place, such as by the horizontal set screws shown in FIG. 5, or by other means. This allows the file to be used for other tasks such as sharpening other tools.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

We claim:

1. A blade sharpener, comprising:

a sharpener body which defines a file cavity for holding a file with a planar surface, and a blade slot for guiding a blade to be sharpened, in which said blade slot is wider than said blade, so that said blade may contact said planar surface of said file at an angle chosen by the user;

a file for securing in said file cavity, and for contacting said blade to be sharpened; and a file securing means, for releasably securing said file in said sharpener body;

wherein said sharpener body is configured to guide a blade to be sharpened into said blade slot, either normal to said file planar surface and against a blade slot sidewall or at an angle to said file planar surface for a beveled edge on said blade, where manual back and forth motion of said blade to be sharpened against said file results in a blade sharpened at the angle of the blade and the file planar surface.

2. The blade sharpener of claim 1 in which said file is a generally rectangular hand file.

3. The blade sharpener of claim 1 in which said file securing means is a plurality of set screws which press on said planar surface of said file and press said file against a base of said file cavity.

4. The blade sharpener of claim 1 in which said file cavity is oriented at an angle other than 90 degrees to said blade slot, so that contact between said blade to be sharpened and said file planar surface results in a beveled edge on said blade.

5. The blade sharpener of claim 1 in which said file cavity is normal to said blade slot, but wider than said blade, so that said blade may contact said planar surface of said file at an angle chosen by the user.

6. The blade sharpener of claim 5 which is further configured to sharpen drywall finishing blades.

7. The blade sharpener of claim 1 which further includes a plurality of access cavities at different angles, for sharpening a blade from a number of pre-selected angles.

8. The blade sharpener of claim 7, in which said access cavities are disposed at angles of 90, 30, and 45 degrees in relation to said file planar surface.

9. The blade sharpener of claim 1 in which said sharpener body comprises three parts, a base section, a first shoulder section, and a second shoulder section, with said shoulder sections being connected to said base section so that a file cavity and at least one blade slot is formed.

10. The blade sharpener of claim 9 which further includes horizontal file set screws, which enable one of the shoulder sections to be removed while still securing the file in the file cavity, so that the sharpener body and file can be used without one of the shoulder sections.

* * * * *